US010212762B2

(12) United States Patent
Hong

(10) Patent No.: US 10,212,762 B2
(45) Date of Patent: Feb. 19, 2019

(54) DRIVER SELECTION TYPE RAPID HEATING CONTROL METHOD AND ECO VEHICLE THEREOF

(71) Applicants: Hyundai Motor Company, Seoul (KR); Kia Motors Corporation, Seoul (KR)

(72) Inventor: Gyu-Sik Hong, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 374 days.

(21) Appl. No.: 14/938,413

(22) Filed: Nov. 11, 2015

(65) Prior Publication Data

US 2017/0027022 A1 Jan. 26, 2017

(30) Foreign Application Priority Data

Jul. 20, 2015 (KR) ..... 10-2015-0102515

(51) Int. Cl.
*H05B 1/02* (2006.01)

(52) U.S. Cl.
CPC ..... *H05B 1/0236* (2013.01); *H05B 2203/02* (2013.01)

(58) Field of Classification Search
CPC ..... H05B 1/0236; H05B 1/0238; H05B 3/12; H05B 3/0042; H05B 2203/02
USPC ..... 219/202, 507, 497, 505
See application file for complete search history.

(56) References Cited

U.S. PATENT DOCUMENTS

| | | | | |
|---|---|---|---|---|
| 9,631,547 | B2 * | 4/2017 | Porras | F01P 7/165 |
| 9,944,150 | B2 * | 4/2018 | Sutherland | B60H 1/00492 237/44 |
| 2015/0158366 | A1 * | 6/2015 | Lee | B60H 1/2218 701/36 |

FOREIGN PATENT DOCUMENTS

| | | | |
|---|---|---|---|
| JP | 2005-138635 | A | 6/2005 |
| JP | 2005-319910 | A | 11/2005 |
| JP | 2008-168805 | A | 7/2008 |
| JP | 2009-255917 | A | 11/2009 |
| JP | 2014-028531 | A | 2/2014 |
| JP | 2015-077852 | A | 4/2015 |
| KR | 10-2012-0060112 | A | 6/2012 |

* cited by examiner

*Primary Examiner* — Mark Paschall
(74) *Attorney, Agent, or Firm* — Mintz Levin Cohn Ferris Glovsky and Popeo, P.C.; Peter F. Corless

(57) ABSTRACT

A driver selection type rapid heating control method is provided. In an eco-vehicle, when an off signal of a hybrid electric vehicle (HEV) input pressed by a driver is received in response to detecting a heating signal while being driven in an electric vehicle mode (EV mode), the rapid heating is performed by an idling of an engine and an operation of a positive temperature coefficient (PTC) heater. When an on signal of the HEV input is detected, rapid heating is performed by a driving of an engine and the operation of the PTC heater. Thus, the rapid heating is performed with minimal fuel consumption against battery consumption under conversion into the EV mode, in particular, rapid windshield glass defrosting is performed for securing a field of view while driving by the driver selection.

16 Claims, 5 Drawing Sheets

DRIVER SELECTION TYPE RAPID HEATING CONTROL METHOD AND ECO VEHICLE THEREOF

CROSS-REFERENCE TO RELATED APPLICATIONS

This application claims priority to Korean Patent Application No. 10-2015-0102515, filed on Jul. 20, 2015, which is incorporated herein by reference in its entirety.

BACKGROUND

Field of the Invention

The present invention relates to an eco vehicle, and more particularly, to a driver selection type rapid heating control method and an eco vehicle thereof capable of performing rapid heating with minimal fuel consumption against battery consumption.

Description of Related Art

Generally, among eco vehicles, a plug-in hybrid electric vehicle (PHEV) is designed to improve capacity and performance of a battery applied as a power source in a low-speed, low-torque section in a hybrid electric vehicle (HEV) or an electric vehicle (EV), thereby driving a considerable portion of vehicle driving using electric energy of the battery. In particular, the PHEV applies an electric vehicle mode (EV mode) as a basic driving pattern and intercepts an EV mode conversion to prevent a driving distance of a charge depletion mode (CD mode) from reducing during a heating control during a positive temperature coefficient (PTC) heater and idling of the engine or the PTC heater and a driving of an engine, thereby preventing a battery charging amount from being consumed for heating.

For example, a heating mode of the PHEV divides an exterior temperature based on −13° C. and is divided into a heating control of −13° C. or greater using the idling of the engine and a low voltage PTC heater and a heating control of −13° C. or less using the idling of the engine and the low voltage PTC heater and performs a control to prevent the conversion into the EV mode an intention to drive a vehicle in the EV mode during the heating control of −13° C. or less, thereby preventing an adverse effect on the CD mode. However, in the heating mode of the PHEV, the heating control of −13° or greater may cause the reduction in drivability due to torque instability of a motor, noise and vibration due to the idling of the engine, and the like and the heating control of −13° or less may prohibit the EV mode from being selected.

In particular, when a cooling water heating type PTC is applied, the PHEV may be excellent in heating and defrosting performance but may not demonstrate the greatest advantage due to the substantial reduction in a CD mode driving distance. In addition, the heating control limit of the PHEV may not rapidly perform windshield glass defrosting causing difficult for a driver to secure a field of view while driving, which may lead to a safety problem.

SUMMARY

The present invention provides a driver selection type rapid heating control method and an eco vehicle thereof capable of maintaining advantages of an EV mode and rapidly performing windshield glass defrosting for securing a field of view while driving, by implementing a driver selection mode performing rapid heating with minimal fuel consumption against battery consumption.

Other objects and advantages of the present invention may be understood by the following description, and become apparent with reference to the exemplary embodiments of the present invention. Additionally, it is obvious to those skilled in the art to which the present invention pertains that the objects and advantages of the present invention can be realized by the means as claimed and combinations thereof.

In accordance with an exemplary embodiment of the present invention, a driver selection type rapid heating control method may include: providing a hybrid electric vehicle (HEV) button to a driver and recognizing, by a controller, on and off signals of the HEV button, when a heating signal is recognized during a driving of an electric vehicle mode (EV mode); performing, by the controller, an idling of an engine and an operation of a positive temperature coefficient (PTC) heater, when the off signal of the HEV button is recognized; and operating, by the controller, the engine and the positive temperature coefficient (PTC) heater, when the on signal of the HEV button is recognized to execute a mode change rapid heating.

The mode change rapid heating may include detecting a cooling water temperature based on the driving of the engine, comparing the cooling water temperature with an excess target discharge temperature, when the cooling water temperature is less than the excess target discharge temperature, continuously operating the engine and the PTC heater, and when the cooling water temperature reaches the excess target discharge temperature, stopping the driving of the engine and the operation of the PTC heater to perform the conversion into the EV mode. The excess target discharge temperature may be the target discharge temperature of about +8° C.

The method may additionally include: detecting the cooling water temperature based on the stopping of the engine in the EV mode, comparing the cooling water temperature with the target discharge temperature, when the cooling water temperature is greater than the target discharge temperature, maintaining the EV mode, and when the cooling water temperature is less than the target discharge temperature, again operating the PTC heater while again driving the engine.

The driver selection type rapid heating control method may further include: determining whether the heating control is performed when the EV mode is maintained and when the heating signal is recognized and providing, by the controller, the HEV button, when the EV mode is not maintained (e.g., a mode change is executed). The maintaining of the EV mode may apply external temperature and air conditioning setting temperature and when the external temperature which is equal to or less than about −10° C. and air conditioning setting temperature which is equal to or greater than about 25° C. are satisfied, the HEV button may be provided (e.g. may be selected).

In accordance with another exemplary embodiment of the present invention, an eco-vehicle may include: a hybrid electric vehicle (HEV) button (e.g., interface, input, etc.) configured to provide an electric vehicle mode (EV mode) for heating to terminate the EV mode based on a driver selection; and a controller configured to monitor data of external temperature, vehicle indoor temperature, and engine cooling water temperature, provide the HEV button in response to recognizing a heating signal during the EV mode driving, operate a positive temperature coefficient (PTC) heater while idling the engine during an off signal of the HEV button and operate the PTC heater while being driven by the engine during an on signal of the HEV button.

The HEV button may be disposed at a driver seat cluster and the HEV button may include a character display of "press the HEV button for rapid heating". The controller may include a heating condition determiner and the heating condition determiner may be configured to execute the monitoring. The controller may be any one of a hybrid control unit (HCU), an engine electronic control unit (ECU), and a full auto temperature control system electronic control unit (FATC ECU).

BRIEF DESCRIPTION OF THE DRAWINGS

A brief description of each drawing is provided to more sufficiently understand drawings used in the detailed description of the present invention.

DETAILED DESCRIPTION

Figure 1A:
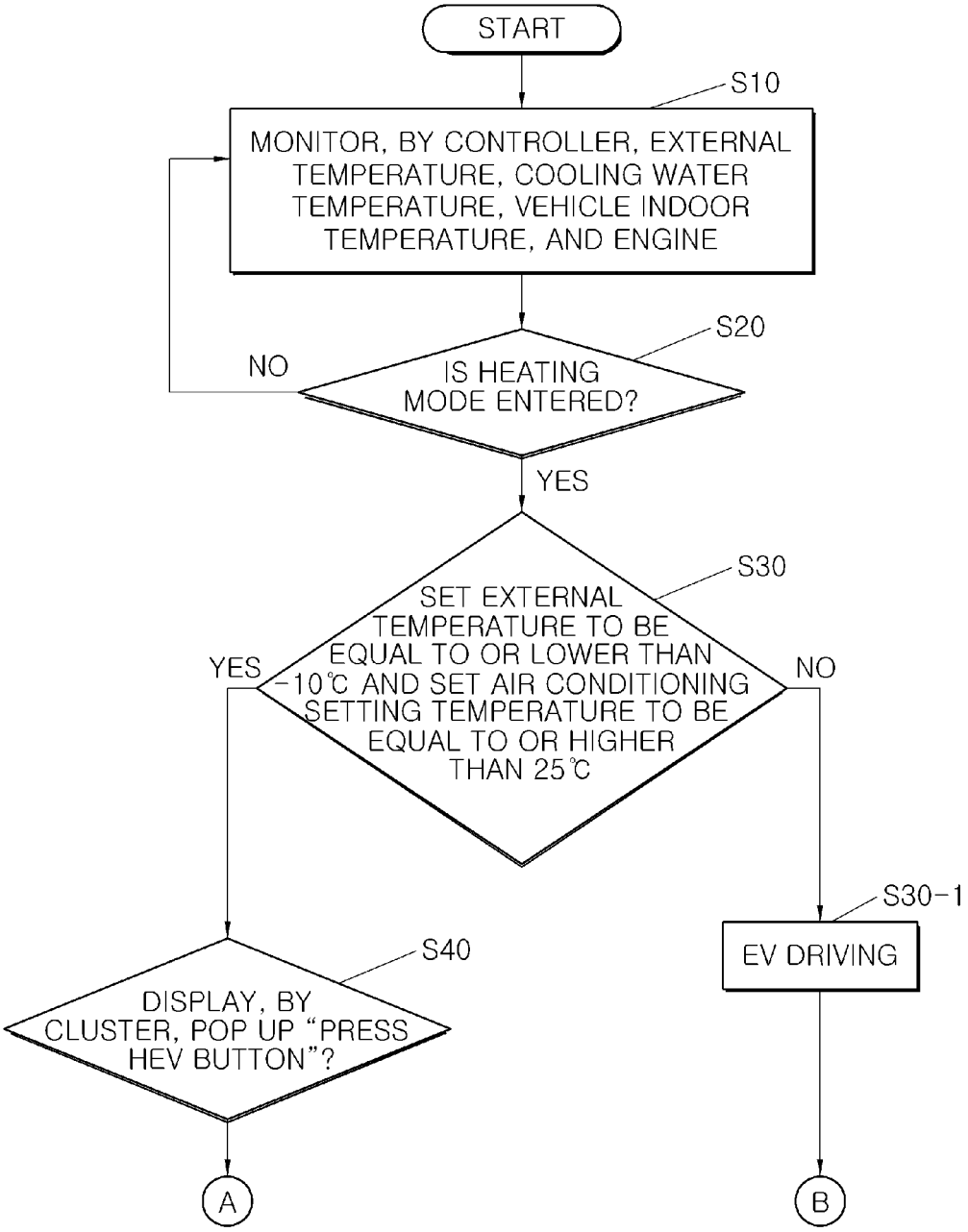
FIGS. 1A and 1B are a flow chart of a driver selection type rapid heating control method according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, exemplary embodiments of the present invention will be described in detail with reference to the accompanying drawings and these exemplary embodiments may be implemented in various forms by a person having ordinary skill in the art to which the present invention pertains and therefore the present invention is not limited to the embodiments described herein.

Figure 1B:
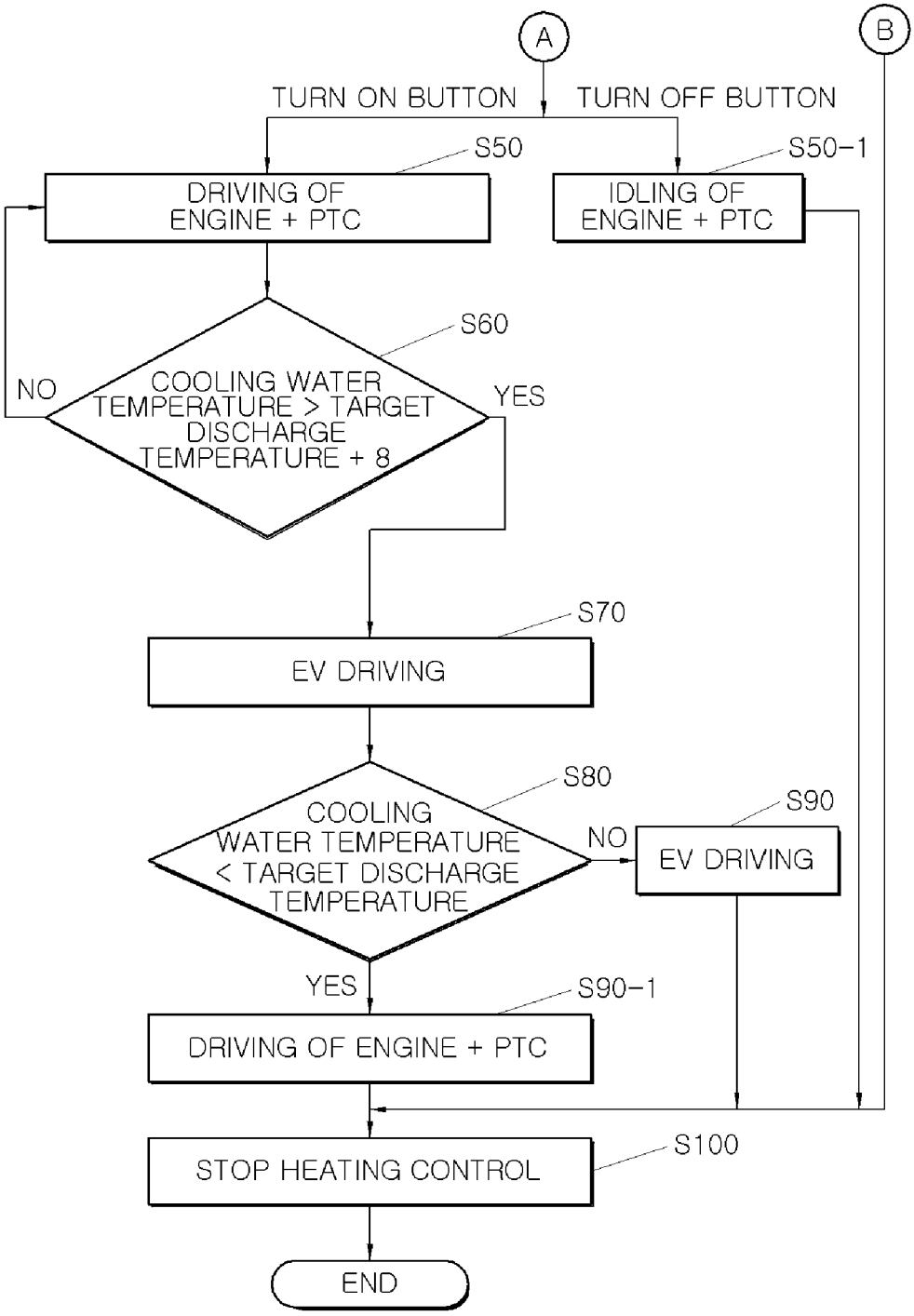

FIGS. 1A and 1B illustrate a flow chart of a driver selection type rapid heating control method according to an exemplary embodiment of the present invention. As illustrated in FIGS. 1A and 1B, according to the driver selection type rapid heating control method, a controller configured to operate and adjust vehicle heating may be configured to receive a driver input (e.g., request) to select a vehicle driving mode that performs rapid heating with minimal fuel consumption against battery consumption, thereby performing the rapid heating with minimal fuel consumption against battery consumption, in particular, maintaining advantages of an EV mode and rapidly performing windshield glass defrosting for securing a field of view while driving. The driver input(s) may be provided as a driver selection mode and may be received via by a hybrid electric vehicle (HEV) button disposed at a driver seat cluster. Therefore, the driver may select air conditioning and fuel efficiency which contradict each other during heating.

Figure 2:
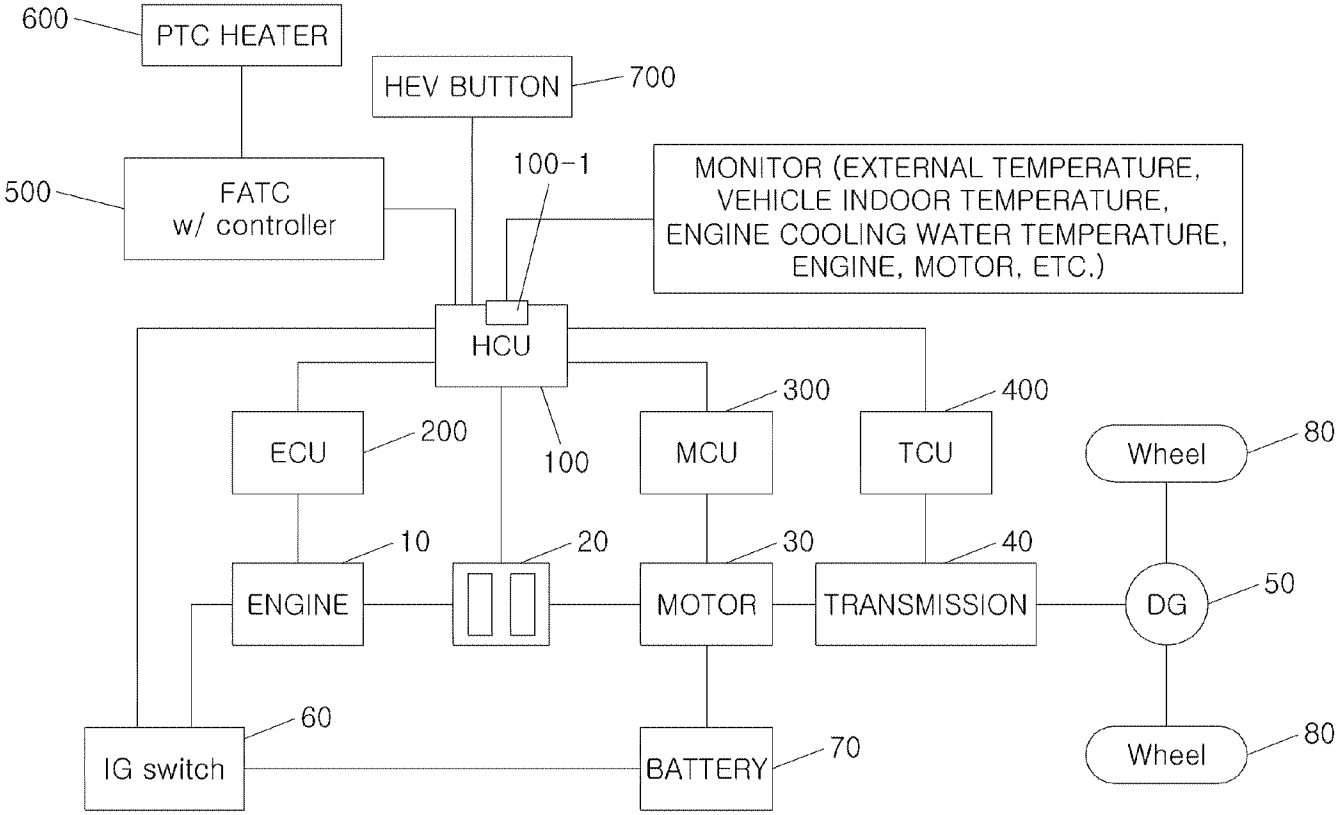
FIG. 2 is a diagram illustrating an eco-vehicle in which the driver selection type rapid heating control method is implemented according to an exemplary embodiment of the present invention.

Meanwhile, FIG. 2 illustrates an example of the eco vehicle in which the driver selection type rapid heating control method is implemented. As illustrated in FIG. 2, the eco-vehicle may include an engine 10, an engine clutch 20, a motor 30, a transmission 40, a differential gear 50, an ignition switch 60, a battery 70, and a wheel 80. For example, the engine clutch 20 may be configured to adjust power between the engine 10 and the motor 30, the ignition switch 60 may be configured to start the engine 10 or start the motor using the battery 70 connected to the motor 30, and the battery 70 may be configured to supply a voltage to the motor 30 during an EV driving mode and may be charged by recovering regenerative braking energy during deceleration or may be charged by external power.

Further, the eco-vehicle may include a hybrid control unit (HCU) 100, an engine electronic control unit (ECU) 200, a motor control unit (MCU) 300, and a transmission control unit (TCU) 400, as a controller configured to operate a vehicle. For example, the HCU 100 is an upper controller configured to operate a PHEV, in which the controller may be connected to each apparatus via a network to transmit and receive information among the apparatuses and execute a cooperative control to adjust an output torque of the engine 10 and the motor 30 and adjust a targeted gear ratio, to drive the vehicle.

In particular, the HCU 100 may include a heating condition determiner 100-1 along with a nonvolatile memory, in which the heating condition determiner 100-1 may be configured to monitor external temperature, vehicle indoor temperature, engine cooling water temperature, the engine 10, the motor 30, etc., to determine a driving mode based on the driver requests (e.g., input) during heating and may be configured to provide information to the driver. The ECU 200 may be configured to operate the engine 10 and the motor 30. The TCU 400 may be configured to operate the transmission 40.

Further, the eco-vehicle may be configured to use a full auto temperature control system (FATC) 500 and a positive temperature coefficient (PTC) heater 600 as a vehicle heater and may include a hybrid electric vehicle (HEV) 700 as a driver selection mode means. For example, the FATC 500 is a system configured to automatically adjust a blowing direction, a blowing volume, and an introduction state of indoor air and exterior air to maintain a clear indoor space independent of an external state and may include an FATC electronic control unit (FATC ECU). The FATC 500 may be connected to the HCU 100 via the network to allow the FATC 500 and the HCU 100 to exchange information and perform the cooperate control.

Therefore, the driving mode selection and the control performance during the heating control may be implemented by any one of the FATC ECU, the engine ECU 200, and the HCU 100. The PTC heater 600 may be a low voltage type. The HEV button 700 may be disposed in the vehicle cluster and may be configured to receive the driver selection using an on/off button or other interface/input device and may be configured to display a message (e.g., a pop up message) "press an HEV button for rapid heating". Therefore, in the eco-vehicle according to the exemplary embodiment of the present invention, it may be possible to improve the consumer satisfaction and the vehicle marketability by provided the driver with the right (e.g., capability) to select the air conditioning and the fuel efficiency which contradict each other.

Figure 3:
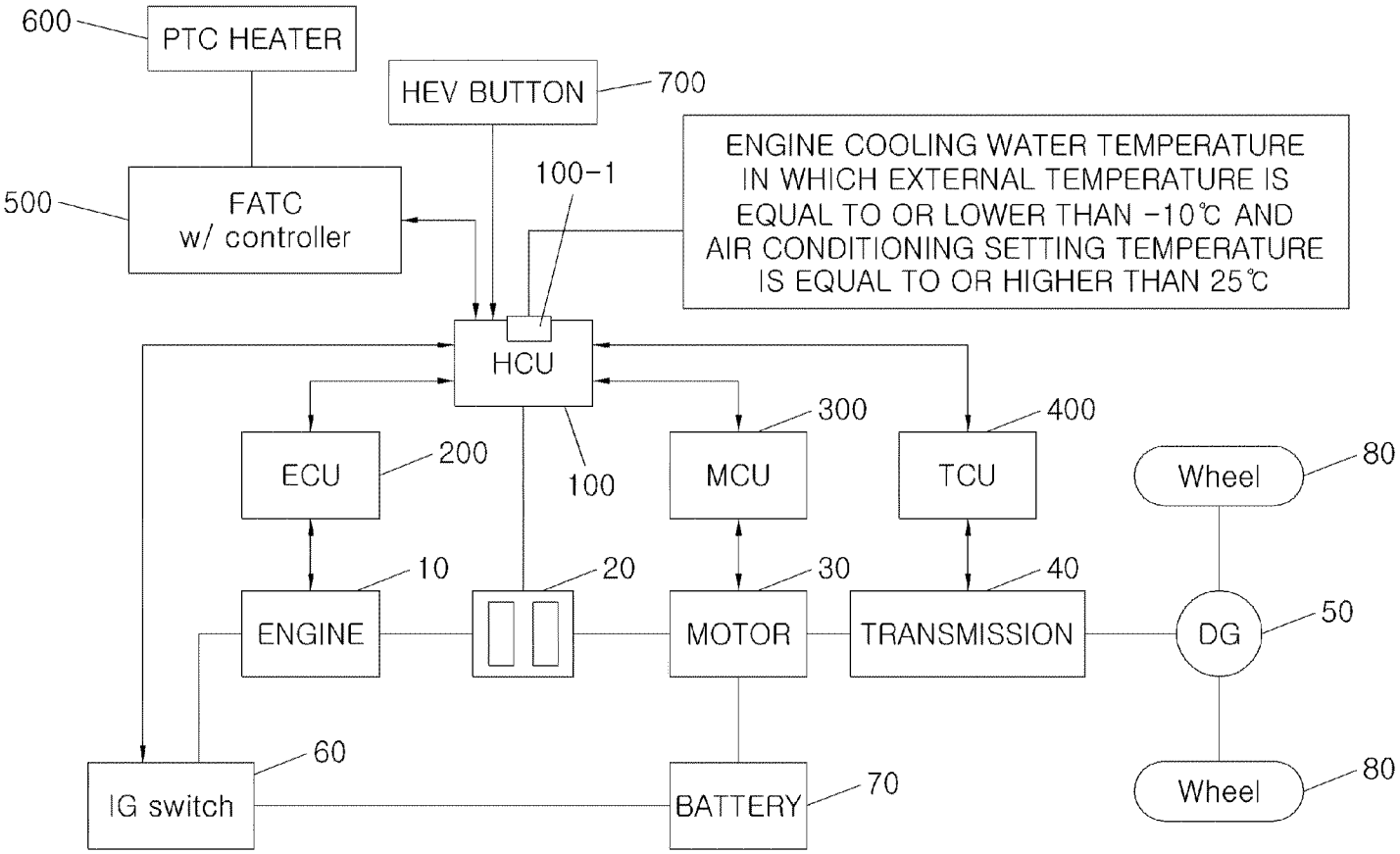
FIG. 3 is a diagram illustrating a state of performing rapid heating by applying an HEV button to a plug-in hybrid vehicle among eco-vehicles according to an exemplary embodiment of the present invention.

Hereinafter, the driver selection type rapid heating control method of FIG. 1 according to the exemplary embodiment of the present invention will be described with reference to the plug-in hybrid vehicle of FIG. 3 and FIG. 4. Hereinafter, the rapid heating control may be implemented by the controller and the controller is described as the HCU 100. However, the FATC ECU or the engine ECU 200 may be configured to perform a cooperative control with the heating condition determiner 100-1 of the HCU 100 and the controller may be the FATC ECU or the engine ECU 200.

In S10, the HCU 100 may be configured to monitor the state of the engine 10 and the motor 30 and the state of the external temperature, the cooing water temperature, the vehicle indoor temperature, etc., detected by various sensors. The monitored data may be used to select the PHEV driving modes during a heating mode entry. In S20, the HCU 100 may be configured to detect the heating mode entry while the PHEV is being driven. In particular, the HCU 100 may be configured to detect the heating mode entry using a signal from a heating mode switch or button pressed or engaged by the driver. However, the heating mode entry may be performed by the FATC ECU of the FATC 500 or the engine ECU 200 based on the cooperative control with the HCU 100.

In S30, the HCU 100 may be configured to determine external conditions for selecting the driving mode of the PHEV in the heating mode entry state. Referring to FIG. 3, the heating condition determiner 100-1 may be configured to detect an external temperature detection value and an air conditioning setting temperature value set in the FATC 500 or directly input by the driver from the data to be monitored and determine which driving mode corresponds to the external temperature and the air conditioning setting temperature. Accordingly, the HCU 100 may provide a priority to the EV mode in the PHEV driving mode during the heating control. For example, the determination may include applying the conditions that the external temperature is equal to or less than about 10 below zero (−10° C.) and the air conditioning setting temperature is equal to or greater than about 25 above zero (+25° C.). Particularly, the EV mode is in the state in which the PHEV is driven using the power of the driving motor 20.

In S30-1, the HCU 100 may be configured to maintain the PHEV driving mode as the EV mode to perform the heating control, under the condition that the external temperature is equal to or greater than about −10° C. and the air conditioning setting temperature is equal to or less than about +25° C. Therefore, even though the heating is requested (e.g., input) under the condition that the external temperature is equal to or greater than about −10° C. and the air conditioning setting temperature is equal to or less than about +25° C., the PHEV may be configured to execute the heating control when the EV mode which is the current driving mode is maintained.

Particularly, the HCU 100 enters S100 when the driver stops heating or when the temperature reaches the heating temperature to stop the heating control. The heating control may be performed by the FATC ECU of the FATC 500 or the engine ECU 200 based on the cooperative control with the HCU 100. Therefore, the heating control performed at the external temperature which is equal to or greater than about −10° C. and the air conditioning setting temperature which is equal to or less than about +25° C. may be defined as a normal heating mode in which the PHEV sets the EV mode as the driving mode.

Furthermore, in S40, the HCU 100 may exclude the EV mode in the PHEV driving mode and the right (e.g., capability) to select the heating control may be provided to the driver (e.g., the selection is not blocked), under the condition that the external temperature is equal to or greater than about −10° C. and the air conditioning setting temperature is equal to or less than about +25° C. Referring to FIG. 3, when the HEV button 700 is activated in the cluster by the HCU 100, an on or off signal pressed or engaged by the driver may be transmitted to the HCU 100. In particular, the HEV button 700 may be configured to display a message (e.g., a pop up) "for rapid heating, press the HEV button", which may provide guidance to the driver for selection. Then, the HCU 100 may be configured to drive the engine 10 and the PTC heater 600 to perform the rapid heating.

Therefore, the heating control performed at the external temperature which is equal to or less than about −10° C. and the air conditioning setting temperature which is equal to or greater than about +25° C. may define the PHEV driving mode as the driving of the engine or the rapid heating mode in which the PTC operation is performed while the engine is in an idling state. In particular, the driving of the engine may indicated the HEV mode in which the PHEV is driven using a torque of the motor 30 as auxiliary power while using a torque of the engine 10 as main power.

In S50-1, the HCU 100 may be configured to operate the PTC heater 600 to perform the heating control while converting the engine 10 into the idling state, based on the received off signal of the HEV button 700. Therefore, the PHEV may implement the idling of the engine 10 in the EV mode state. As the result, compared with the EV mode, the arrival of the heating mode may be rapidly performed. In particular, the HCU 100 enters S100 when the driver stops the heating performance or when the temperature reaches the heating temperature to stop the heating control. The heating control may be performed by the FATC ECU of the FATC 500 or the engine ECU 200 based on the cooperative control with the HCU 100.

In S50, the HCU 100 may be configured to operate the engine 10 based on the received on signal of the HEV button 700 to operate the PTC heater 600 while converting the PHEV driving mode into the driving of the engine, thereby performing the heating control. Therefore, the PHEV may be converted from the EV mode into the HEV mode. As the result, compared with the EV mode, the heating temperature may be rapidly reached. Particularly, the HCU 100 may be configured to monitor the cooling water temperature increasing by the operation of the engine 10 to convert the PHEV driving mode into the EV mode in the engine driving state based on the cooling water temperature. The cooling water temperature may be detected by a thermostat or a temperature sensor and may then input to the engine ECU 200, the HCU 100, or the FATC ECU to rapidly release the phenomenon that the CD mode driving distance is reduced due to the operation of the PTC heater 600. In particular, the heating control may be performed by the FATC ECU of the FATC 500 or the engine ECU 200 based on the cooperative control with the HCU 100.

In S60, the HCU 100 may be configured to determine an increase amount of the cooling water temperature during the heating control to determine the conversion into the PHEV driving mode. Accordingly, the conditions of cooling water temperature>excess target discharge temperature (target discharge temperature+8° C.) may be applied. The ">" is an inequality sign representing a size relationship between two values and indicates that the currently detected cooling water temperature is a value greater than the excess target discharge temperature (target discharge temperature+8° C.) of the cooling water set as the specific temperature. When the HCU 100 determines that the cooling water temperature is less than reach the target discharge temperature of +8° C., the HCU 100 may be fed back to S50 to sustain the driving of the engine and the PTC operation.

Furthermore, the HCU 100 may be configured to determine that the cooling water temperature reaches the target discharge temperature of +8° C. to convert the PHEV driving mode into the EV mode, thereby performing the heating control. As the result, the operation of the engine 10 and the PTC heater 600 may be stopped. In particular, the heating control may be performed by the FATC ECU of the FATC 500 or the engine ECU 200 based on the cooperative control with the HCU 100.

In S80, the HCU 100 may be configured to determine a decrease amount of the cooling water temperature during the heating control by the EV mode to determine whether to sustain the EV mode or perform the conversion into the driving of the engine. Accordingly, the condition of cooling water temperature<target discharge temperature may be applied. The "<" is an inequality sign representing a size relationship between two values and indicates that currently detected cooling water temperature is a value less than the target discharge temperature of the cooling water set as the specific temperature.

When the HCU 100 determines that the cooling water temperature is greater than the target discharge temperature, the HCU 100 may enter S90 to maintain the EV mode, thereby continuously performing the heating control. Particularly, the HCU 100 may enter S100 when the driver stops the heating control or when the temperature reaches the heating temperature to stop the heating control. The heating control may be performed by the FATC ECU of the FATC 500 or the engine ECU 200 based on the cooperative control with the HCU 100.

Additionally, in S90-1, the HCU 100 may be configured to determine that the cooling water temperature is less than the target discharge temperature to again convert the EV mode into the driving of the engine, thereby performing the heating control. As the result, the engine 10 and the PTC heater 600 may again be operated. In particular, the HCU 100 may enter S100 when the driver stops the heating control or when the temperature reaches the heating temperature to stop the heating control. The heating control may be performed by the FATC ECU of the FATC 500 or the engine ECU 200 based on the cooperative control with the HCU 100.

Figure 4:
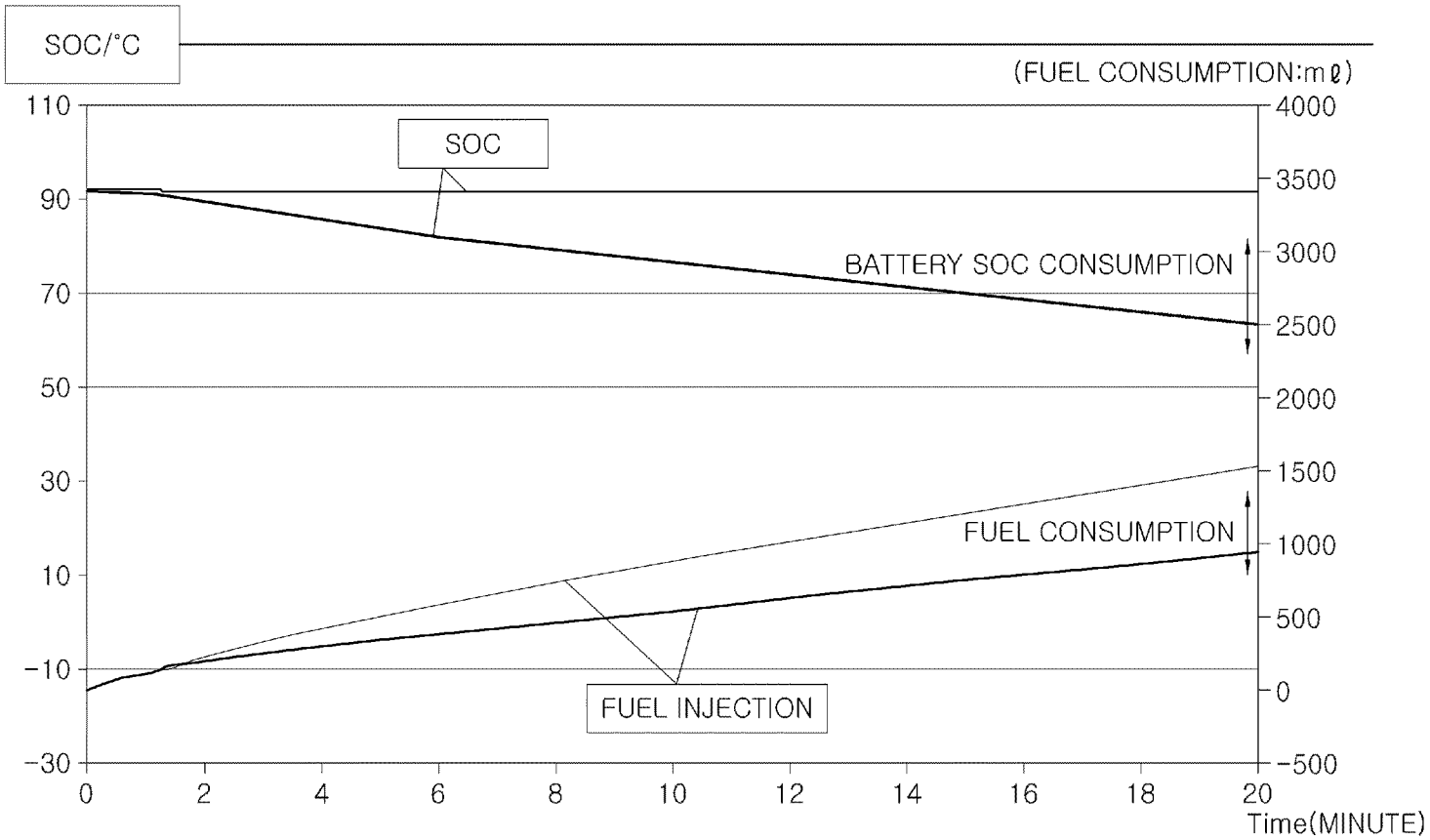
FIG. 4 is a diagram illustrating fuel consumption against battery consumption of the plug-in hybrid vehicle by the driver selection type rapid heating control method according to the exemplary embodiment of the present invention.

Moreover, FIG. 4 is a diagram illustrating fuel consumption against battery consumption by the driver selection type rapid heating control method according to the exemplary embodiment of the present invention. As illustrated in FIG. 4, in the PHEV to which the driver selection type rapid heating control method according to the exemplary embodiment of the present invention is applied, even though the EV mode is converted into the driving of the engine or the engine idling during the heating control, it may be appreciated that the fuel consumption of the engine 10 may be less than SOC consumption of the battery 70 under the same conditions.

For example, the indoor temperature may be improved by about 7.6 while driving for about 20 minutes to improve the heating and defrosting performance and the fuel may be consumed exceeding about 0.6 and the battery charging amount may be saved by about 28.5%. As the result, the PTC heater may be unnecessary by improving the heating performance under the initial conditions to save costs and the right to select the air conditioning and the fuel efficiency which contradict each other may be given to the driver to satisfy customer sensibility.

As described above, in the eco-vehicle according to the exemplary embodiments of the present invention, when the off signal of the hybrid electric vehicle (HEV) button 700 pressed (e.g., engaged) by the driver may be recognized in response to detecting the heating signal while being driven in the electric vehicle mode (EV mode), the rapid heating may be performed by the idling of the engine 10 and the operation of the positive temperature coefficient (PTC) heater 700, while when the on signal of the HEV button 700 is detected, the rapid heating may be performed by the driving of the engine and the operation of the PTC heater 700, thereby performing the rapid heating with the minimal fuel consumption against the battery consumption under the conversion into the EV mode, in particular, performing the windshield glass defrosting for securing the field of view while driving by the driver selection.

As described above, according to the exemplary embodiments of the present invention, it may be possible to perform the rapid heating with the minimal fuel consumption against the battery consumption while maintaining advantages of the eco-vehicle, in particular, the PHEV by the optimization of the air conditioning and the fuel efficiency which contradict each other. Further, according to the exemplary embodiments of the present invention, it may be possible to improve the consumer satisfaction and the vehicle marketability by providing the driver with the capability to select the air conditioning and the fuel efficiency which contradict each other. In addition, according to the exemplary embodiments of the present invention, it may be possible to omit the PTC heater by improving the heating performance during the initial driving of the vehicle by the charge sustaining (CS) and save costs due to the removal of the PTC heater.

The foregoing exemplary embodiments are merely examples to allow a person having ordinary skill in the art to which the present invention pertains (hereinafter, referred to as "those skilled in the art") to easily practice the present invention. Accordingly, the present invention is not limited to the foregoing exemplary embodiments and the accompanying drawings, and therefore, a scope of the present invention is not limited to the foregoing exemplary embodiments. Accordingly, it will be apparent to those skilled in the art that substitutions, modifications and variations can be made without departing from the spirit and scope of the invention as defined by the appended claims and can also belong to the scope of the present invention.

What is claimed is:

1. A driver selection type rapid heating control method, comprising:

providing a hybrid electric vehicle (HEV) button to a driver and detecting, by a controller, on and off signals of the HEV button, when a heating signal is detected during a driving of an electric vehicle mode (EV mode);

performing, by the controller, an idling of an engine in the EV mode and an operation of a positive temperature coefficient (PTC) heater, when the off signal of the HEV button is detected; and performing, by the controller, a driving of the engine in the HEV mode without the EV mode and an operation of the positive temperature coefficient (PTC) heater, when the on signal of the HEV button is detected, wherein the on and off signals of the HEV button are caused by a driver operation.

2. The driver selection type rapid heating control method of claim 1, wherein the HEV button is provided at a seat cluster.

3. The driver selection type rapid heating control method of claim 2, wherein the HEV button includes a character output of "press the HEV button for rapid heating".

4. The driver selection type rapid heating control method of claim 1, wherein the PTC heater is a low voltage type.

5. The driver selection type rapid heating control method of claim 1, further comprising:

detecting, by the controller, a cooling water temperature based on the driving of the engine;

comparing, by the controller, the cooling water temperature with an excess target discharge temperature;

when the cooling water temperature is less than the excess target discharge temperature, maintaining, by the controller, the operation of the engine and the PTC heater; and when the cooling water temperature reaches the excess target discharge temperature, stopping, by the controller, the operation of the engine and the PTC heater to perform the conversion into the EV mode.

6. The driver selection type rapid heating control method of claim 5, wherein the excess target discharge temperature is the target discharge temperature of about +8° C.

7. The driver selection type rapid heating control method of claim 5, further comprising:

detecting, by the controller, the cooling water temperature based on the stopping of the engine in the EV mode;

comparing, by the controller, the cooling water temperature with the target discharge temperature;

when the cooling water temperature is greater than the target discharge temperature, maintaining, by the controller, the EV mode; and when the cooling water temperature is less than the target discharge temperature, operating, by the controller, the PTC heater while again operating the engine.

8. The driver selection type rapid heating control method of claim 1, further comprising:

determining, by the controller, whether the heating control is performed when the EV mode is maintained, when the heating signal is recognized and providing, by the controller, the HEV button, when the EV mode is changed.

9. The driver selection type rapid heating control method of claim 8, wherein the EV mode maintenance determination applies external temperature and air conditioning setting temperature and when the external temperature which is equal to or less than about 10° C. and air conditioning setting temperature which is equal to or greater than about 25° C. are satisfied, the HEV button is provided.

10. The driver selection type rapid heating control method of claim 1, wherein the controller is any one of a hybrid control unit (HCU), an engine electronic control unit (ECU), and a full auto temperature control system electronic control unit (FATC ECU).

11. An eco-vehicle, comprising:

a hybrid electric vehicle (HEV) button configured to provide an electric vehicle mode (EV mode) for heating to a driver to stop the EV mode based on a driver selection; and a controller configured to monitor data of external temperature, vehicle indoor temperature, and engine cooling water temperature, provide the HEV button in response to detecting a heating signal during the EV mode driving, operate a positive temperature coefficient (PTC) heater while idling the engine in the EV mode in response to detecting an off signal of the HEV button and operate the PTC heater while being driven by the engine in the EV mode in response to detecting an on signal of the HEV button, wherein the on and off signals of the HEV button are caused by a driver operation.

12. The eco-vehicle of claim 11, wherein the HEV button is disposed at a seat cluster.

13. The eco-vehicle of claim 12, wherein the HEV button includes a character output of "press the HEV button for rapid heating".

14. The eco-vehicle of claim 11, wherein the controller includes a heating condition determiner and the heating condition determiner configured to execute monitoring.

15. The eco-vehicle of claim 14, wherein the controller is any one of a hybrid control unit (HCU), an engine electronic control unit (ECU), and a full auto temperature control system electronic control unit (FATC ECU).

16. The eco-vehicle of claim 15, wherein the controller is applied to a plug-in hybrid vehicle.

* * * * *